US008277298B2

(12) United States Patent
Mace et al.

(10) Patent No.: US 8,277,298 B2
(45) Date of Patent: Oct. 2, 2012

(54) ELECTRONIC SINGLE PLAYER TABLE BLACKJACK TOURNAMENT

(75) Inventors: Andrew Mace, Newcastle Under Lyme (GB); Dinesh Jasti, Hyderabad (IN)

(73) Assignee: PartyGaming IA Limited, Hamilton (BM)

( * ) Notice: Subject to any disclaimer, the term of this patent is extended or adjusted under 35 U.S.C. 154(b) by 549 days.

(21) Appl. No.: 12/303,528

(22) PCT Filed: Jun. 5, 2006

(86) PCT No.: PCT/IB2006/002273

§ 371 (c)(1),
(2), (4) Date: Jan. 29, 2010

(87) PCT Pub. No.: WO2007/141591

PCT Pub. Date: Dec. 13, 2007

(65) Prior Publication Data

US 2010/0130275 A1 May 27, 2010

(51) Int. Cl.
*A63F 9/24* (2006.01)

(52) U.S. Cl. ..... 463/12; 463/13; 463/19; 463/42

(58) Field of Classification Search ..... 463/12, 463/13, 19, 42

See application file for complete search history.

(56) References Cited

U.S. PATENT DOCUMENTS

| | | | | |
|---|---|---|---|---|
| 5,823,879 | A | 10/1998 | Goldberg et al. | |
| 6,174,237 | B1 | 1/2001 | Stephenson | |
| 6,183,366 | B1 | 2/2001 | Goldberg et al. | |
| 6,264,560 | B1 | 7/2001 | Goldberg et al. | |
| 6,712,702 | B2 | 3/2004 | Goldberg et al. | |
| 6,860,810 | B2 | 3/2005 | Cannon et al. | |
| 6,908,390 | B2 | 6/2005 | Nguyen et al. | |
| 2002/0195773 | A1 * | 12/2002 | Dunn | 273/274 |
| 2007/0054739 | A1 * | 3/2007 | Amaitis et al. | 463/42 |
| 2008/0070659 | A1 * | 3/2008 | Naicker | 463/12 |
| 2008/0315521 | A1 * | 12/2008 | Reabe, Jr. | 273/292 |
| 2009/0008877 | A1 * | 1/2009 | Smith et al. | 273/292 |

OTHER PUBLICATIONS

International Searching Authority, Notification of Transmittal of the International Search Report and the Written Opinion of the International Searching Authority, or the Declaration, Dec. 22, 2006, 10 pages, ISA—European Patent Office.

* cited by examiner

*Primary Examiner* — Pierre E Elisca
(74) *Attorney, Agent, or Firm* — Beem Patent Law Firm

(57) ABSTRACT

A blackjack tournament including a plurality of players, each seated at a single player table with the same predetermined starting amount of funds to wager, each player being dealt to from at least one deck of playing cards arranged in the same predetermined order as the at least one deck used for each other player.

22 Claims, 20 Drawing Sheets

ELECTRONIC SINGLE PLAYER TABLE BLACKJACK TOURNAMENT

CROSS-REFERENCE TO RELATED APPLICATIONS

This application claims the benefit of priority from international patent application number PCT/IB2006/002273, filed Jun. 5, 2006.

BACKGROUND OF THE INVENTION

1. Field of the Invention

The present invention is directed to a networked game tournament for a game such as blackjack.

2. Description of the Related Art

Blackjack, also known as twenty-one and pontoon in British English, is one of the most popular casino card games in the world. Much of blackjack's popularity is due to the mix of chance with elements of skill and decision making, and the publicity that surrounds the practice of card counting, a skill with which players can turn the odds of the game in their favor by making betting decisions based on the values of the cards known to remain in the deck. Blackjack's precursor was vingt-et-un ("twenty-one"), which originated in French casinos around 1700, and did not offer the 3:2 bonus for a two-card 21.

When blackjack was first introduced in the United States it was not very popular, so gambling houses tried offering various bonus payouts to get the players to the tables. One such bonus was a 10-to-1 payout if the player's hand consisted of the ace of spades and a black Jack (either the Jack of clubs or the Jack of spades). This hand was called a "blackjack" and the name stuck even though the bonus payout was soon abolished.

Blackjack hands are scored by their point total. The hand with the highest total wins as long as it does not exceed 21; a hand with a higher total than 21 is said to bust. Cards numbered two through ten are worth their face value, and face cards (jack, queen, king) are also worth ten. An ace's value is eleven unless this would cause the player to bust, in which case it is worth one. A hand in which an ace's value is counted as eleven is called a soft hand, because it cannot be busted if the player draws another card.

The goal of each player is to beat the dealer by having the higher, unbusted hand. Note that if the player busts he loses, even if the dealer also busts. If both the player and the dealer have the same point value, it is called a "push," and neither player nor dealer wins the hand. Each player has an independent game with the dealer, so it is possible for the dealer to lose to one player, but still beat the other players in the same round.

The minimum bet is printed on a sign on the table and varies from casino to casino, and even table to table. The most common minimum in the U.S. is $5. After initial bets are placed, the dealer deals the cards, either from one or two hand-held decks of cards, known as a "pitch" game, or more commonly from a shoe containing four or more decks. The dealer gives two cards to each player, including himself. One of the dealer's two cards is face-up so all the players can see it, and the other is face down. (The face-down card is known as the "hole card". In European blackjack, the hole card is not actually dealt until the players all play their hands.) The cards are dealt face up from a shoe, or face down if it is a pitch game.

A two-card hand of 21 (an ace plus a ten-value card) is called a "blackjack" or a "natural" and is an automatic winner. A player with a natural is usually paid 3:2 on his bet, although in 2003 some casinos started paying only 6:5 on blackjacks, a move decried by longtime blackjack players.

The play goes as follows: If the dealer has blackjack and the player does not, the player automatically loses. If the player has blackjack and the dealer does not, the player automatically wins. If both the player and dealer have blackjack then it is a push. If neither side has blackjack, then each player plays out his hand, one at a time. When all the players have finished the dealer plays his hand.

The player's options for playing his or her hand are: Hit: Take another card. Stand: Take no more cards. Double down: Double the wager, take exactly one more card, and then stand. Split: Double the wager and have each card be the first card in a new hand. This option is available only when both cards have the same value. Surrender: Forfeit half the bet and give up the hand. Surrender was common during the early- and mid-20th century, but is no longer offered at most casinos.

The player's turn is over after deciding to stand, doubling down to take a single card, or busting. If the player busts, he or she loses the bet even if the dealer goes on to bust as well.

After all the players have finished making their decisions, the dealer then reveals his or her hidden hole card and plays the hand. House rules say that the dealer must hit until he or she has at least 17, regardless of what the players have. In most casinos a dealer must also hit a soft 17 (such as an ace and a 6). Writing on the felt of the table will indicate whether or not the house hits or stands on a soft 17. If the dealer busts then all remaining players win. Bets are normally paid out at the odds of 1:1.

Some common rules variations include: one card split aces: one card is dealt on each ace, player's turn is over. Early surrender: player has the option to surrender before dealer checks for Blackjack. Late surrender: player has the option to surrender after dealer checks for Blackjack. Double-down restrictions: double-down allowed only on certain combinations. Dealer hits a soft seventeen (ace-six, which can play as seven or seventeen) European No-Hole-Card Rule: the dealer receives only one card, dealt face-up, and does not a second card (and thus does not check for blackjack) until players have acted. This means players lose not only their original bet, but also any additional money invested from splitting and doubling down. There are more than a few blackjack variations which can be found in the casinos, each has its own set of rules, strategies and odds. It is advised to take a look at the rules of the specific variation before playing.

A tournament is a competition involving a relatively large number of competitors, all participating in a single sport or game. More specifically, the term may be used in either of two overlapping senses:

1. One or more competitions held at a single venue and concentrated into a relatively short time interval. Some game clubs focus on preparing members for such tournaments. Chess clubs, for instance, frequently employ similar ranking systems, chess clocks, and etiquette to those used in chess tournaments.
2. A competition involving multiple matches, each involving a subset of the competitors, with the overall tournament winner determined based on the combined results of these individual matches. These are common in those sports and games where each match must involve a small number of competitors: often precisely two, as in most team sports, racket sports and combat sports, many card games and board games, and many forms of competitive debating. Such tournaments allow large numbers to compete against each other in spite of the restriction on numbers in a single match.

These two senses are distinct. All golf tournaments meet the first definition, but while matchplay tournaments meet the second, strokeplay tournaments do not, since there are no distinct matches within the tournament. In contrast, football (soccer) leagues like the FA Premier League are tournaments in the second sense, but not the first, having matches spread across many stadiums over a period of up to a year. Many tournaments meet both definitions; for example, the Wimbledon tennis championship.

In one card game, contract bridge, a "tournament" is a tournament in the first sense above, composed of multiple "events," which are tournaments in the second sense. Some events may be single-elimination, double-elimination, or Swiss style. However, "Pair events" are the most widespread. In these events, an identical deal (or board) is played in multiple rubbers. The North-South (NS) pair in one such rubber is measured not against the East-West (EW) pair in that same rubber, but rather against all the other NS pairs playing the same board in other rubbers.

Thus pairs are rewarded for playing the same cards better than others have played them. Several systems provide a predetermined schedule of fixtures based on the number of pairs and boards to be played, to ensure a good mix of opponents, and that no pair plays the same board twice. In duplicate bridge, a player normally plays with the same partner throughout an event. The two are known as a "pair". There are two exceptions: on team events with five or six members swapping partners for portions of the event, and in individual tournaments, in which players change partners for each round. An individual event in duplicate bridge is one where each round a player is paired with a different partner.

Scoring is usually using matchpoint pairs scoring, but IMP pairs scoring can be used. There are various methods for assigning partners. In some methods, a given set of players always sit North, another set sit South, another set sit East, and a final set always sit West. This can be used to ensure that each pair consists of a relatively experienced or skilled player, and a relatively inexperienced player. Individual events are more complex to run, and require that the players get accustomed to new partners on a frequent basis. Also, the outcome depends more on luck than in other types of events, as a good player often cannot do much when paired with a bad player, especially if the deal is complex. For those reasons they are less popular and less common than pair or team events, but some players are very fond of them.

Today, many games can be played over some form of network, most commonly the Internet. The expansion of online gaming has reflected the overall expansion of the Internet. Online games can range from simple text based games to games incorporating complex graphics and virtual worlds populated by many players simultaneously. Many different styles of play are available online. Many online games have associated online communities, making online games a form of social activity beyond single player games.

BRIEF SUMMARY OF THE INVENTION

A novel electronic single player blackjack tournament is provided, including a plurality of players, each seated at a single player table with the same predetermined starting amount of funds to wager; each player being dealt to from at least one deck of playing cards arranged in the same predetermined order as the at least one deck used for each other player. Following the completion of the hand by each player, a leader board, which lists all the players in the tournament and their corresponding funds, is updated. Then, the next hand of the tournament is dealt to each player; each player again being dealt to from at least one deck of playing cards arranged in the same predetermined order as the at least one deck used for each other player. At the end of the tournament the players are ranked according to their final chip counts, and prizes are distributed in accordance with the prize structure.

These and other features and advantages are evident from the following description of the present invention, with reference to the accompanying drawings.

DETAILED DESCRIPTION OF THE INVENTION

1. Example of Electronic "Online" Play

Figure 1:
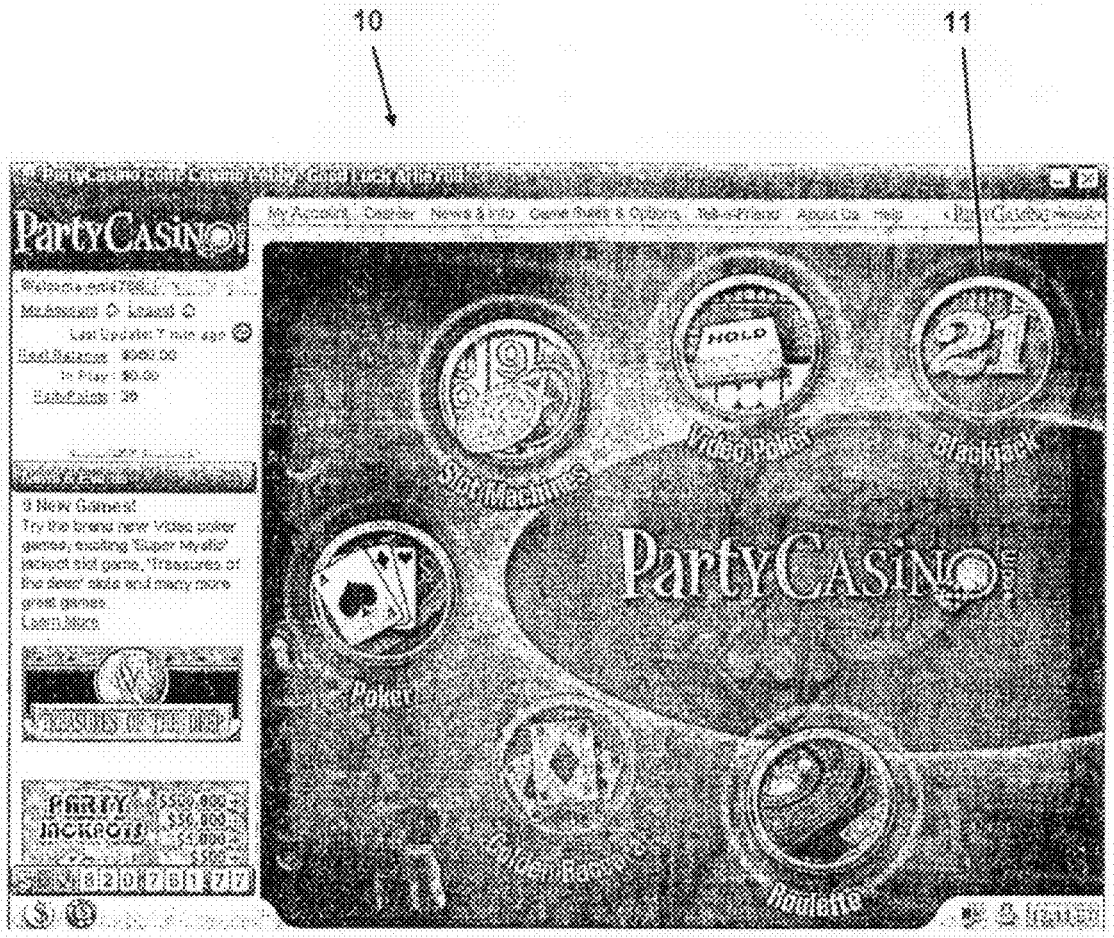
FIG. 1 is screen shot showing a main lobby of a networked casino program, as viewed by a prospective player.

A player may open a blackjack table by selecting the blackjack button in the lobby or by selecting the blackjack button on any of the poker tables. A player's chips may be stacked in denominations of $1, $5, $25 and $100 at the right side of the table window. A player may select the amount the player wants to wager on a given hand by clicking on the chip of that denomination Likewise, a player may decrease the amount wagered by clicking on the 'Bet' stack.

Once the wager is placed, a player click on a 'Deal' button. The 'Deal' button will be activated only if a bet amount equal to or more than the minimum bet amount has been wagered. The dealer deals two cards face up to you and deals two cards to himself. The first dealer card is dealt face up and the second face down. Depending on the strength of the player's cards, the player may choose one of several options: 'Hit', 'Stand', 'Double', 'Split', or 'Surrender'. These are decided as per game rules. The dealer check to see if the dealer has Blackjack before the player may draw his third card. The 'Insurance' option is offered to the player in case the dealer has an Ace as his first card.

Once either the player or the dealer stands or busts, the results are displayed just above the 'Deal' button. To continue the game with the same bet, click on 'Repeat Bet' button. To clear the game and place a new bet, click on 'Clear' To place a new bet, click on the desired chip denomination. Your current account balance is displayed in the bottom right-hand corner.

Click on 'Rebuy' to transfer a complete or partial amount. Check the appropriate radio button and enter the desired amount. If you have exhausted all your available balance and have no funds remaining, click on 'Rebuy' followed by a PartyAccount '$' button to add more funds to your real money account. Note that the 'In Play' amount shown on a PartyAccount page does not include the amount that is currently wagered on the Blackjack table.

Click on 'Rules' to view the game rules. Click on 'Game logs' to view the logs of previously played games. Click on 'Exit Game' to stop playing.

2. Game Options

STAND: Click on the stand button to keep your hand at its current value. If you are satisfied with your hand, you may choose to stand at any time. Click 'Stand' and when the dealer completes his or her hand, the hands will be compared.

HIT: To be dealt another card, click on 'Hit'. You may continue to deal cards to your hand until you either stand or go bust.

DOUBLE DOWN: After you are dealt your first two cards (any value), you will see the option to 'Double Down' appear. Once this option is selected, the bet amount is automatically doubled and you will be dealt one more card. The hand will auto-stand after this card. Doubling down is also provided as an option after splitting. However, if your account balance is not sufficient for the additional bet, the double down option will not be offered. In the event that you lose the bet, you will forfeit the entire bet amount—the initial bet and the additional amount placed for the double down option.

Figure 8A:
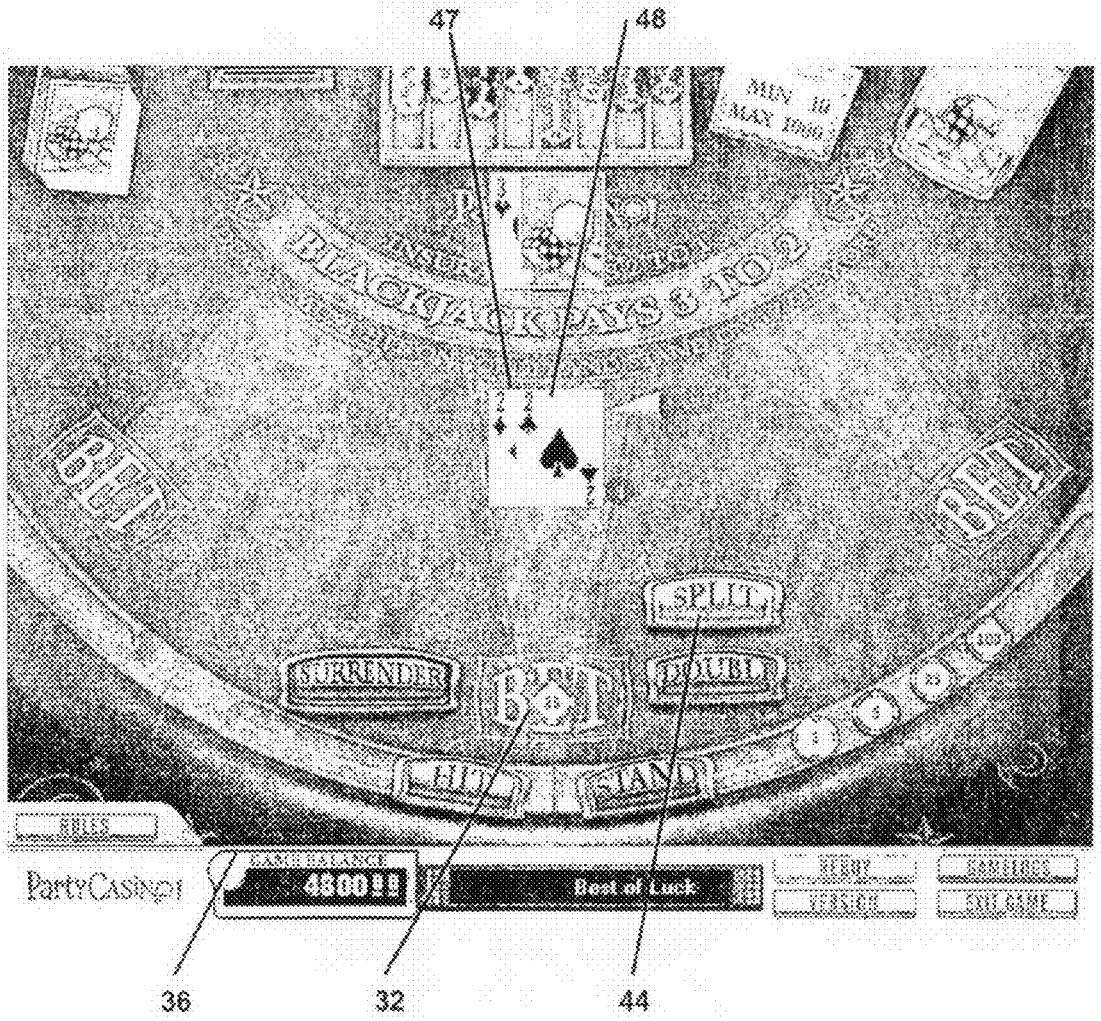
FIGS. 8*a*-8*f* are screen shots showing a single-player blackjack table of a networked blackjack program, wherein a player has chosen to "split" his original hand into two hands, doubled his wager, and played each new hand individually, as viewed by the player.

SPLIT: Referring to FIG. 8*a*, if a player has a first card 47 and a second card 48 of the same value (e.g. a pair of sevens, 10s, etc., or a King and a Jack and so on), a player may select the split option 44 to divide the cards into two hands. This option is also available in the event that you are dealt a pair of aces as your first two cards. Once this option is selected, an additional bet, equal to your original bet 32, is automatically placed. If the hand qualifies for split but the player's account balance 36 is insufficient for the additional bet, the split option 44 will not be offered. A player may draw as many cards as he wishes on each split hand, with the exception of splitting on Aces. If Aces are split, only one card will be dealt to each Ace. If a 10-value card is dealt to either Ace, the hand is counted as 21, not Blackjack.

Figure 8B:
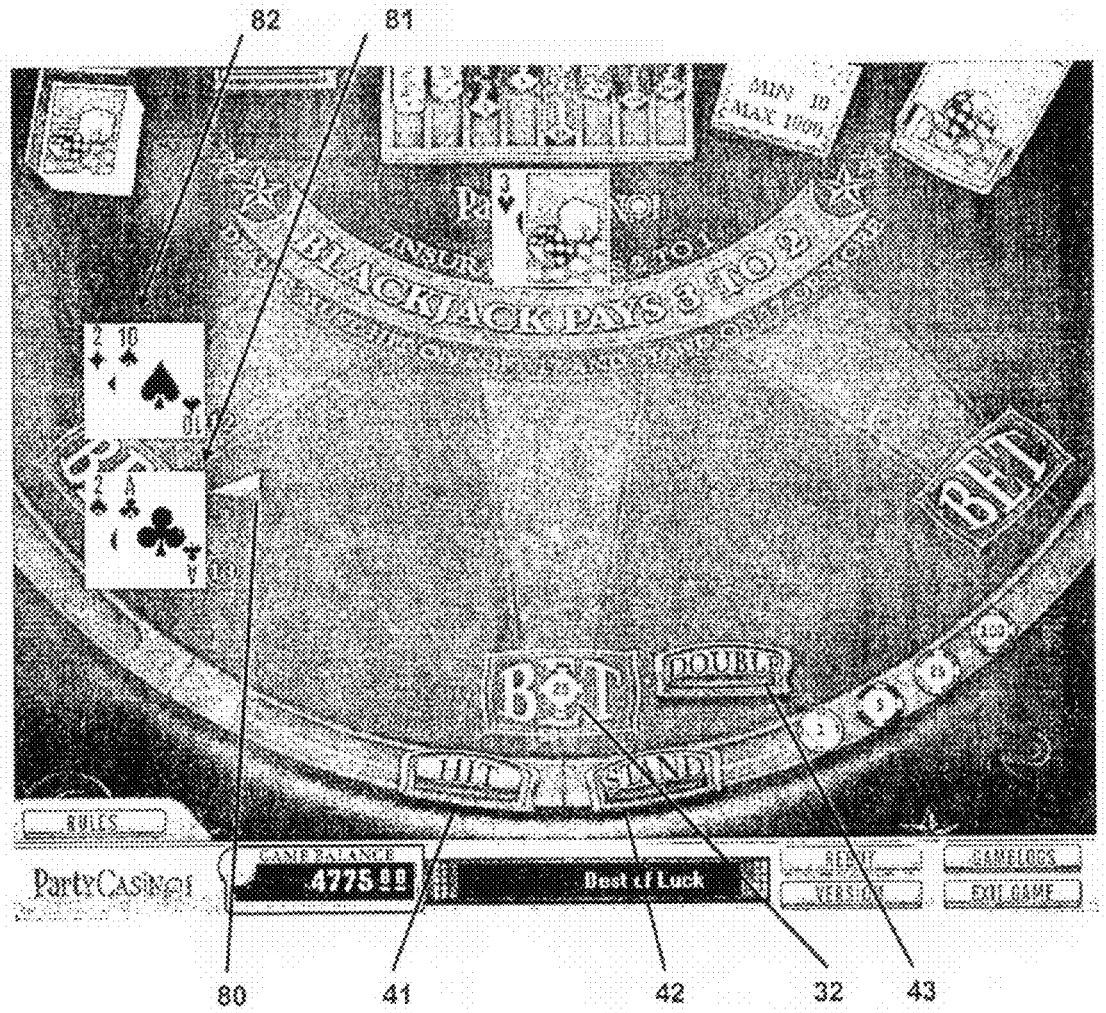
Figure 8C:
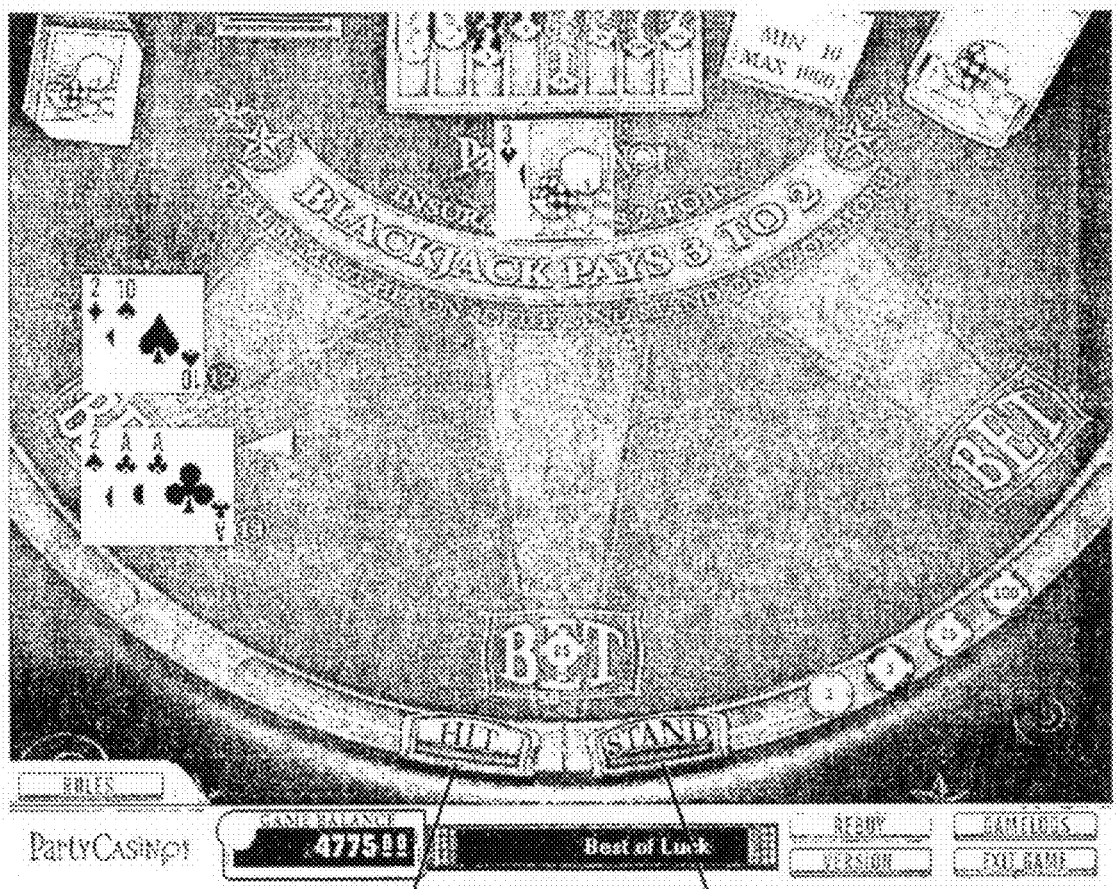
Figure 8D:
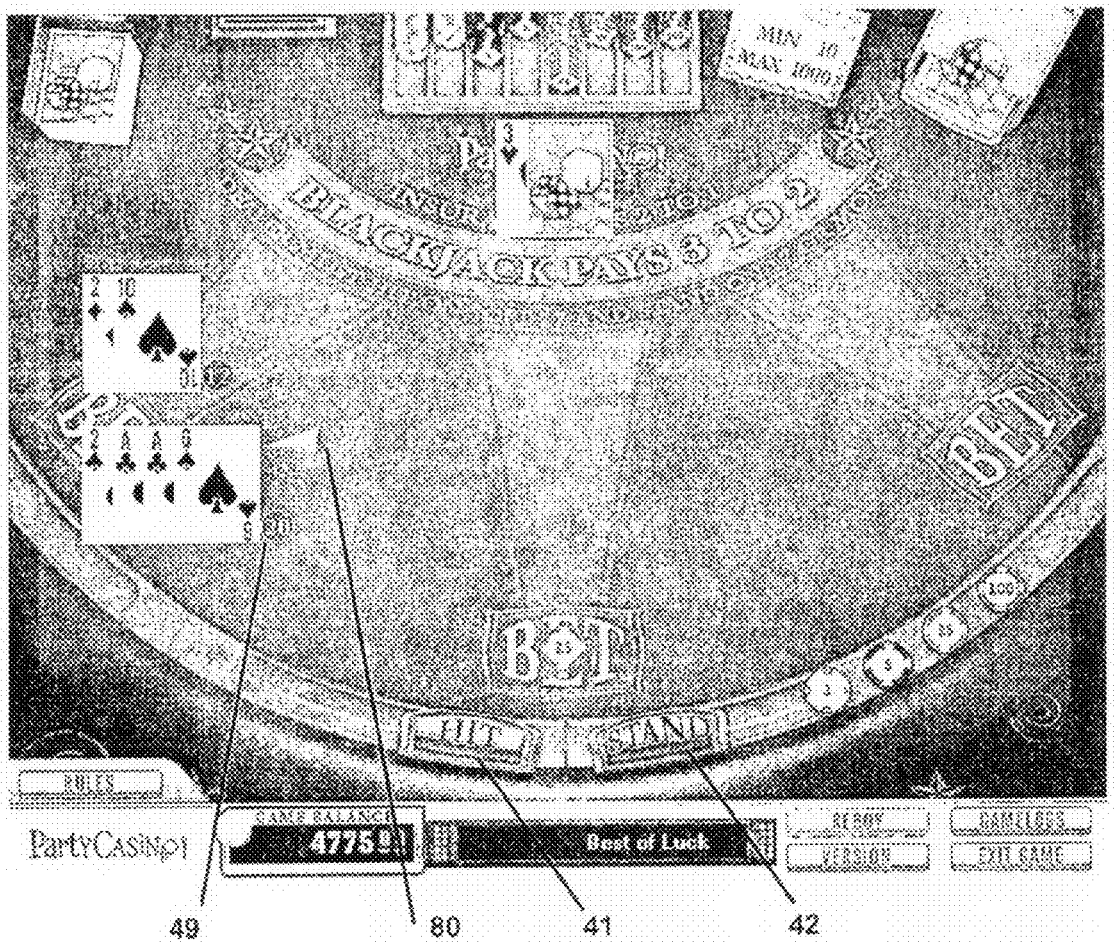
Figure 8E:
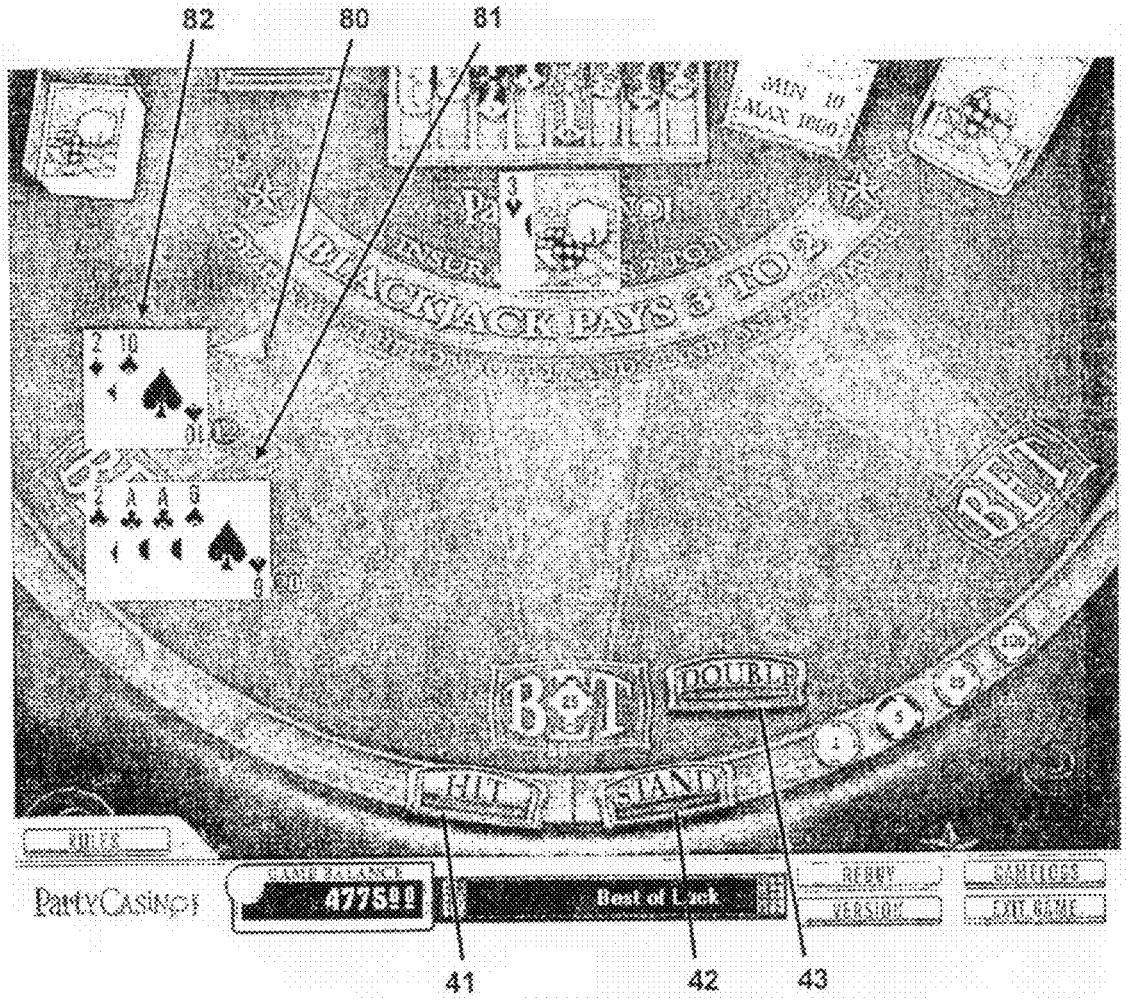
Figure 8F:
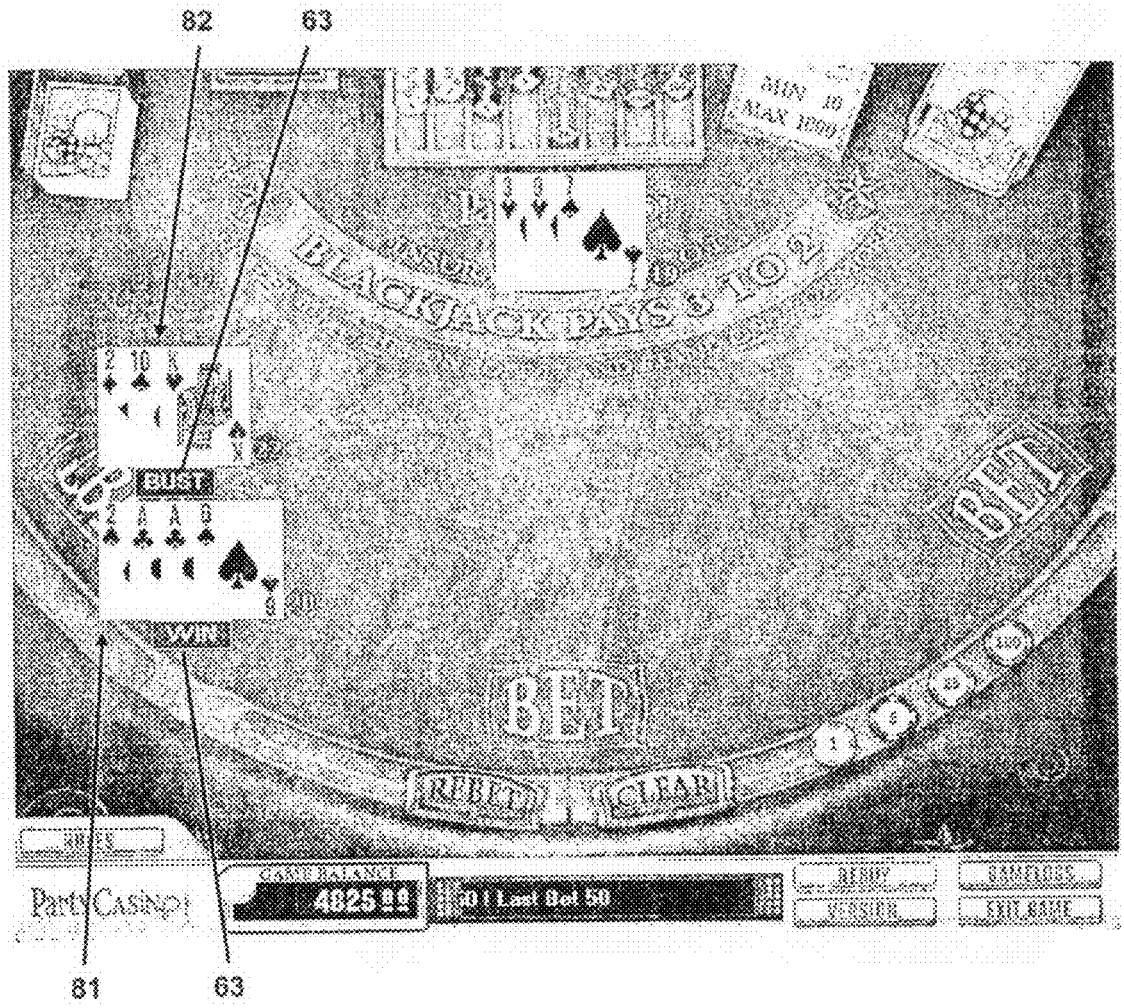

HOW TO PLAY THE SPLIT OPTION: Referring to FIG. 8*b*, when the split option is clicked, the cards are divided into two hands, a first hand 81 and a second hand 82, and one more card is dealt to each of the hands. An arrow 80 pointing to a hand indicates that it is active. Referring to FIGS. 8*b*-8*d*, a player may choose from a plurality of offered options (hit option 41, stand option 42, or double down option 43), depending on the player's hand as the hand progresses. Referring to FIG. 8*e*, once the first hand 81 is decided, the arrow 80 moves to the second hand 82. Once again, a player may choose from a plurality of offered options (hit option 41, stand option 42, or double down option 43), depending on the player's hand. Referring to FIG. 8*f*, a player has chosen to split his hand into a first hand 81 and a second hand 82. The outcome indicator 63 of the first hand 81 shows that the player has won the first hand 81, but the outcome indicator 63 of the second hand 82 shows that the player has busted or lost the second hand 82.

Figure 7:
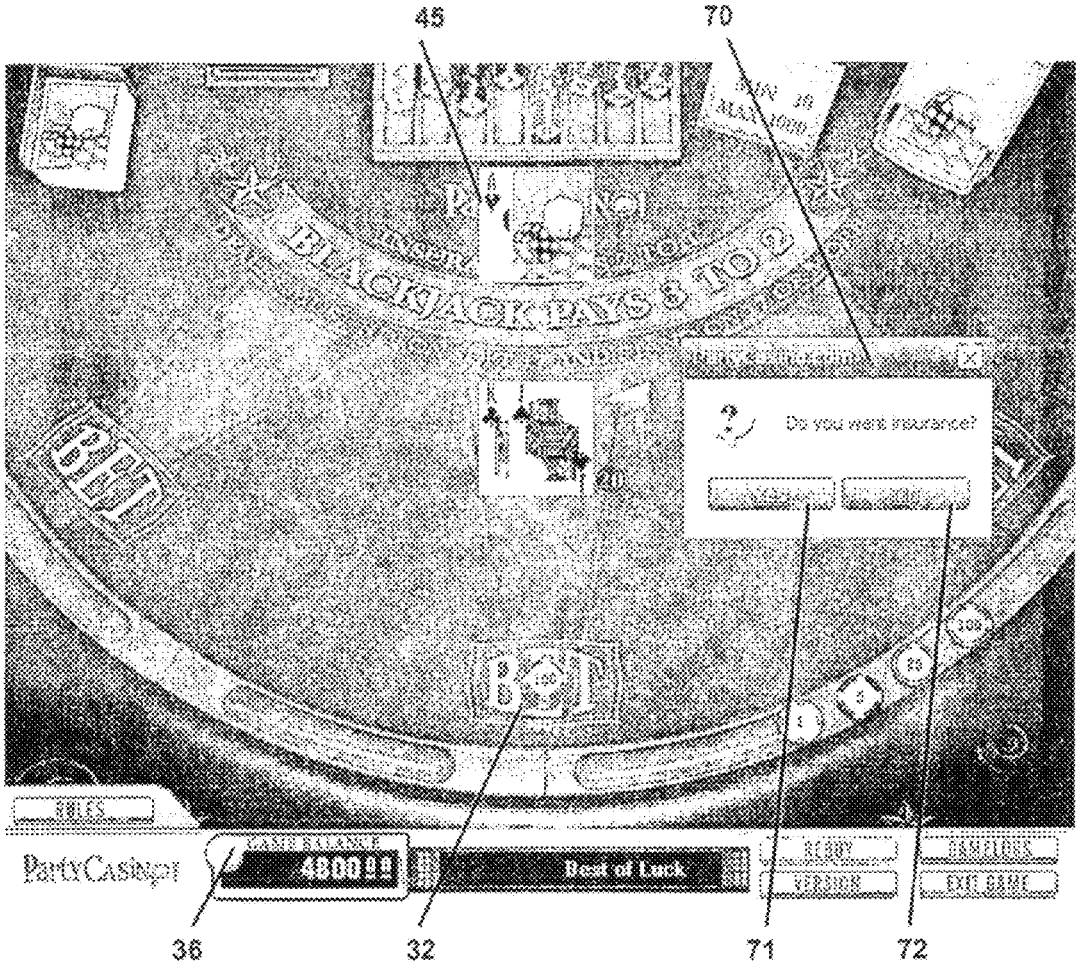
FIG. 7 is a screen shot showing a single-player blackjack table of a networked blackjack program, wherein the dealer has an Ace showing and the player is offered "insurance," as viewed by the player.

INSURANCE: Referring to FIG. 7, the insurance option 70 gives that player a chance to protect himself if he believes the dealer might have Blackjack. If the dealer's face up card 45 is an Ace, the player may choose to insure his hand against the dealer's Blackjack by choosing a "Yes" option 71 of the insurance option 70. If the player chooses to decline the insurance option 70, the player may select a "No" option 72 of the insurance option 70. Insurance costs fifty percent of the bet 32 and is in addition to your initial bet 32. Once a player opts for insurance, the additional bet is automatically placed. If the dealer has a Blackjack, the insurance bet pays 2:1 and the player will lose the initial bet 32. In the event of the dealer not having a Blackjack, the player loses the insured bet and the game continues for the initial bet 32. Insurance is not offered to the player if the player has a Blackjack. If the hand qualifies for insurance but the player's account balance 36 is insufficient for the additional bet, the insurance option 70 will not be offered.

SURRENDER: As your point total is announced, you may select to discontinue play of your hand for that round and surrender only one-half of your wager. You have the option to surrender on the first two cards. This decision must be made prior to indicating whether you wish to double down, split pairs, stand and/or hit. The surrender option is not offered if the dealer has Blackjack. Click on 'Surrender' to surrender your cards. Surrender is allowed and half of the bet forfeited after the dealer has checked for a Blackjack (a two-card count of 21). If the dealer's second card does not result in a Blackjack, one-half of your wager will be returned. The game is completed after the dealer has checked for a Blackjack.

DETAILED DESCRIPTION OF THE SELECTED DRAWINGS

The illustrated embodiment described herein includes the components for operating a single player table, blackjack tournament in an electronic format. In this format players will pay to enter a tournament, the house will deduct a specified portion of the entry fee (typically 10%) and the remaining funds will be split as determined by some prearranged formula or table according to the number of entries. Each player who has entered the tournament will be seated at a single player table with a specified amount of chips. The minimums and maximum bets are specified as part of the set up of the tournament.

Figure 2:
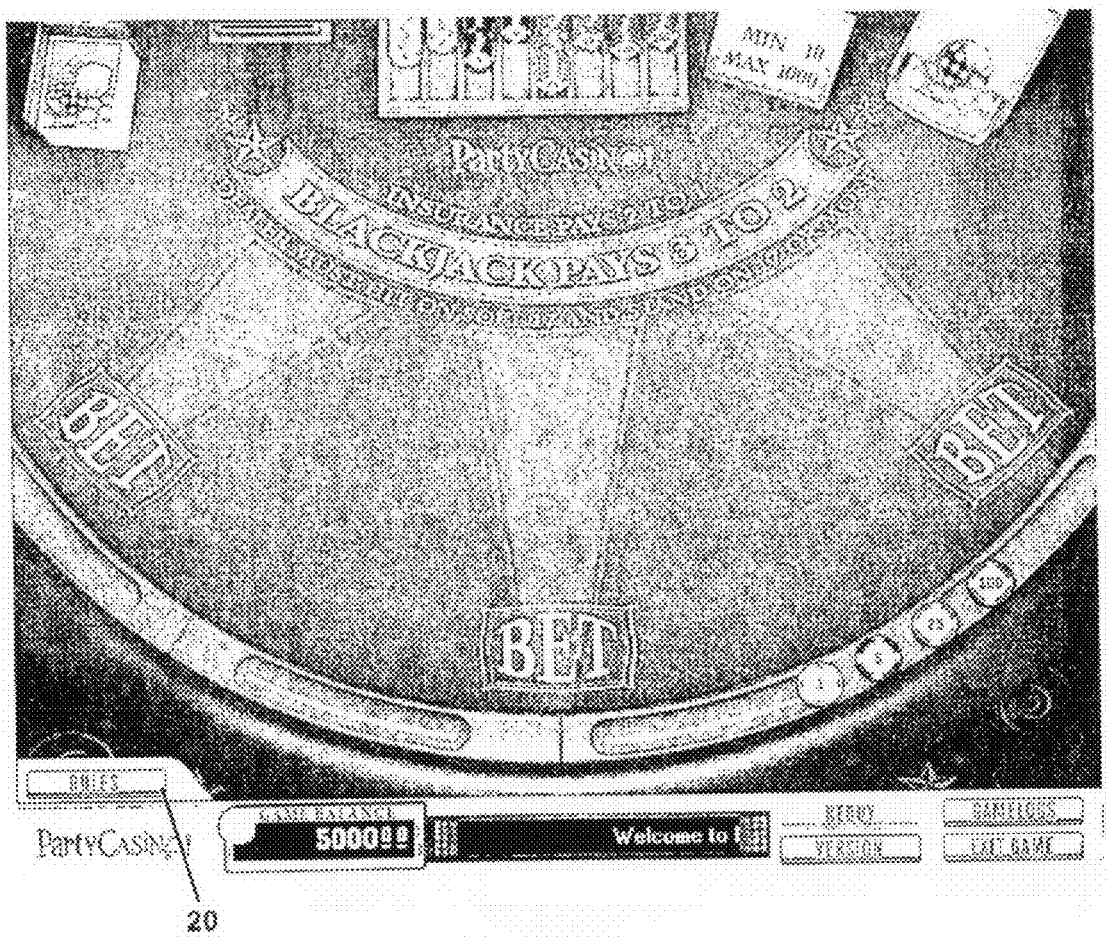
FIG. 2 is a screen shot showing a single-player blackjack table of a networked blackjack program, as viewed by a prospective player.

Referring to FIG. 1, a screen shot shows a main lobby 10 of a networked casino program, as viewed by a prospective player. The lobby 10 includes an option to play blackjack, represented by a blackjack radio button 11. FIG. 2 is a screen shot showing a single-player blackjack table of a networked blackjack program, as viewed by a prospective player. A prospective player who is unfamiliar with the game of blackjack may select a "Rules" radio button 20 which will display or pop-up the rules of the game of blackjack.

Figure 3:
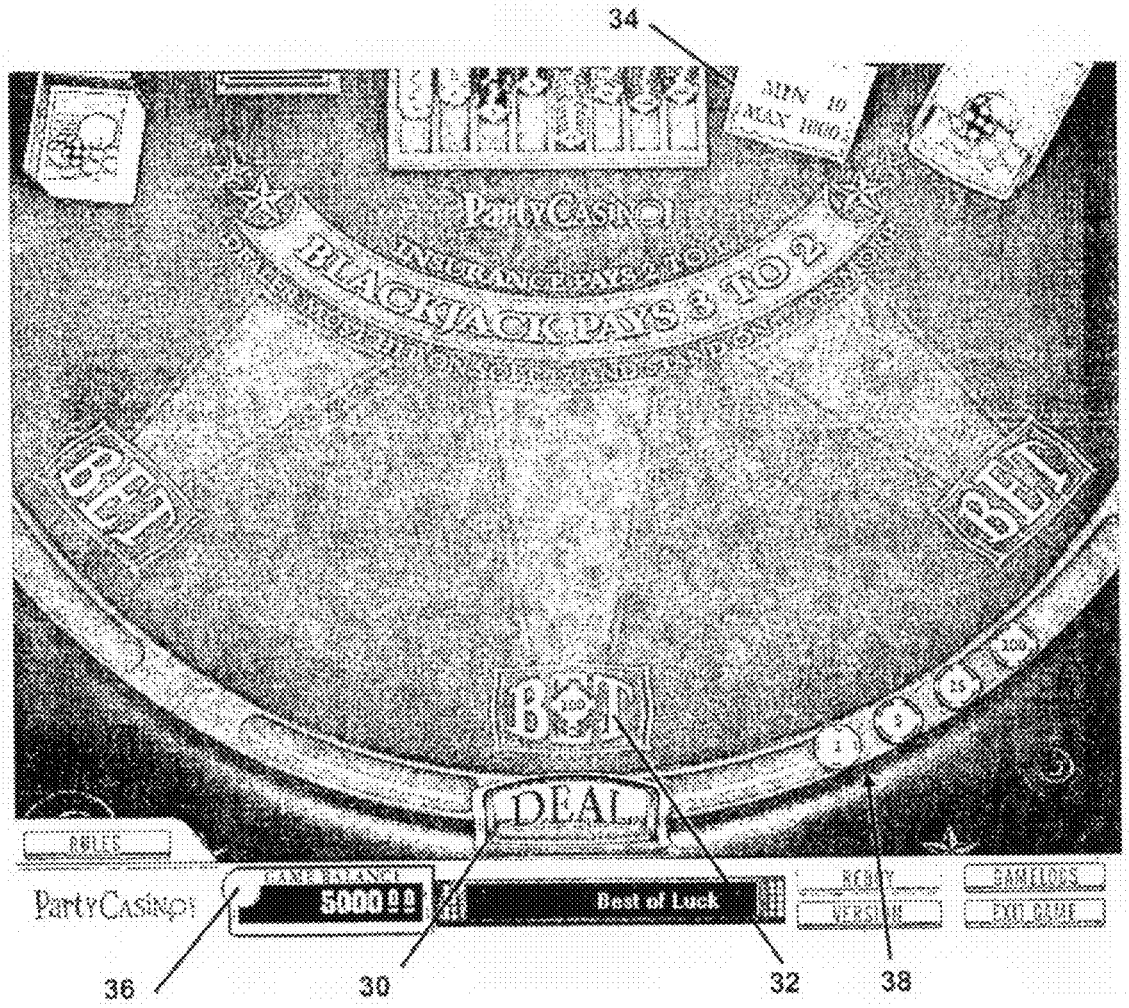
FIG. 3 is a screen shot showing a single-player blackjack table of a networked blackjack program, wherein a player has placed a bet and a "deal" radio button appears, as viewed by the player.

Referring to FIG. 3, a screen shot shows a single-player blackjack table of a networked blackjack program, wherein a player has placed a bet 32 and a "deal" radio button 30 appears. Near the top of FIG. 2, is a table limit card 34 that displays to the player the minimum and maximum allowed wagers at this table. FIG. 2 also shows a balance 36 that displays the available funds to the player to this table. Also, FIG. 2 depicts betting chips 38. In this embodiment, the betting chips 38 represent $1, $5, $25, and $100. The player selects one or more betting chips 38 to place the wager in an amount to the player's choosing. In other embodiments of the present invention the betting chips 38 may be in other denominations, depending on the table limit for a given table.

Figure 4:
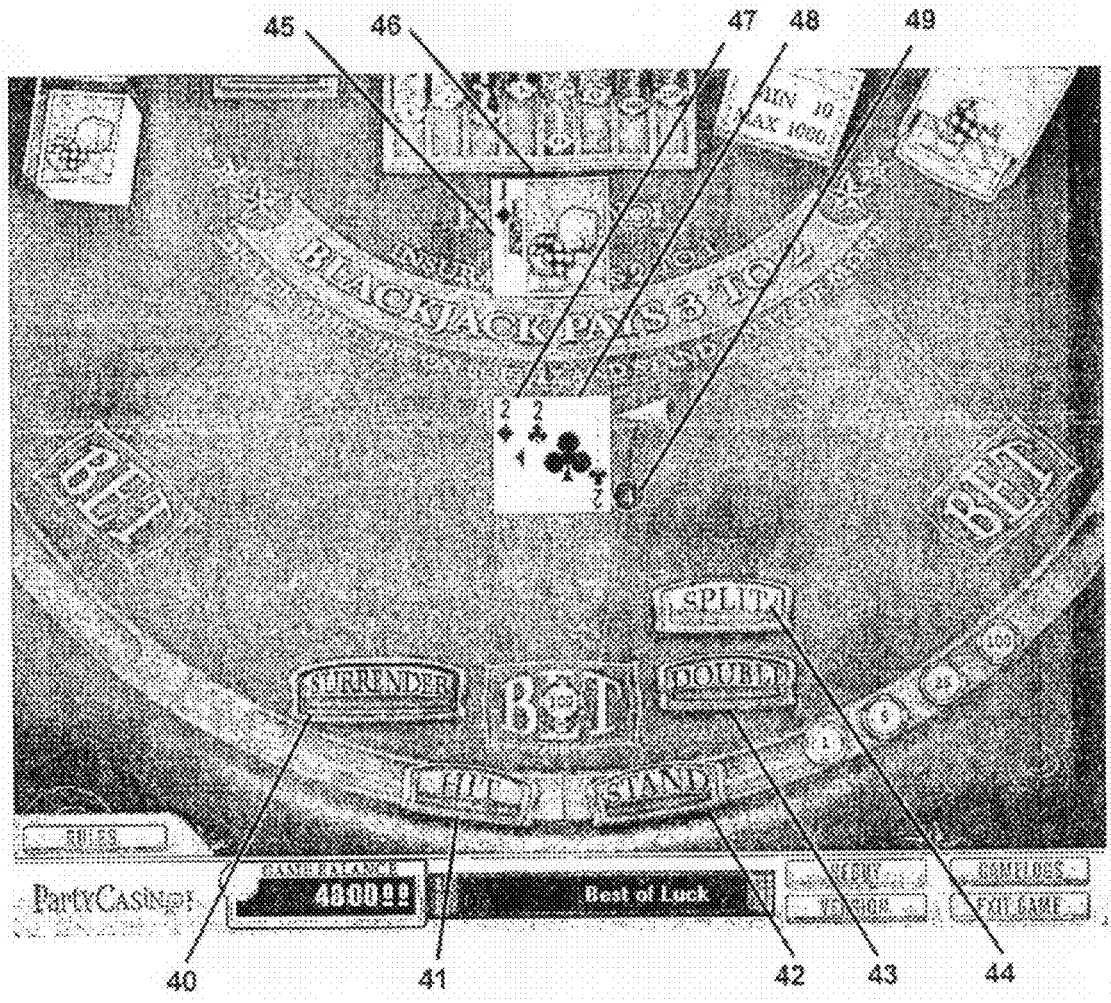
FIG. 4 is a screen shot showing a single-player blackjack table of a networked blackjack program, wherein the player's and the dealer's hands have been dealt and the player's options appear as radio buttons, as viewed by the player.

Referring to FIG. 4, a screen shot shows a single-player blackjack table of a networked blackjack program, wherein a player's hand, comprising a first card 47 and a second card 48, and a dealer's hand, comprising a face up card 45 and a face down card 46, have been dealt and the player's options appear as radio buttons. Possible player options may include a surrender option 40, a hit option 41, a stand option 42, a double down option 43, or a split option 44. The player's point total 49 is also displayed.

Figure 5:
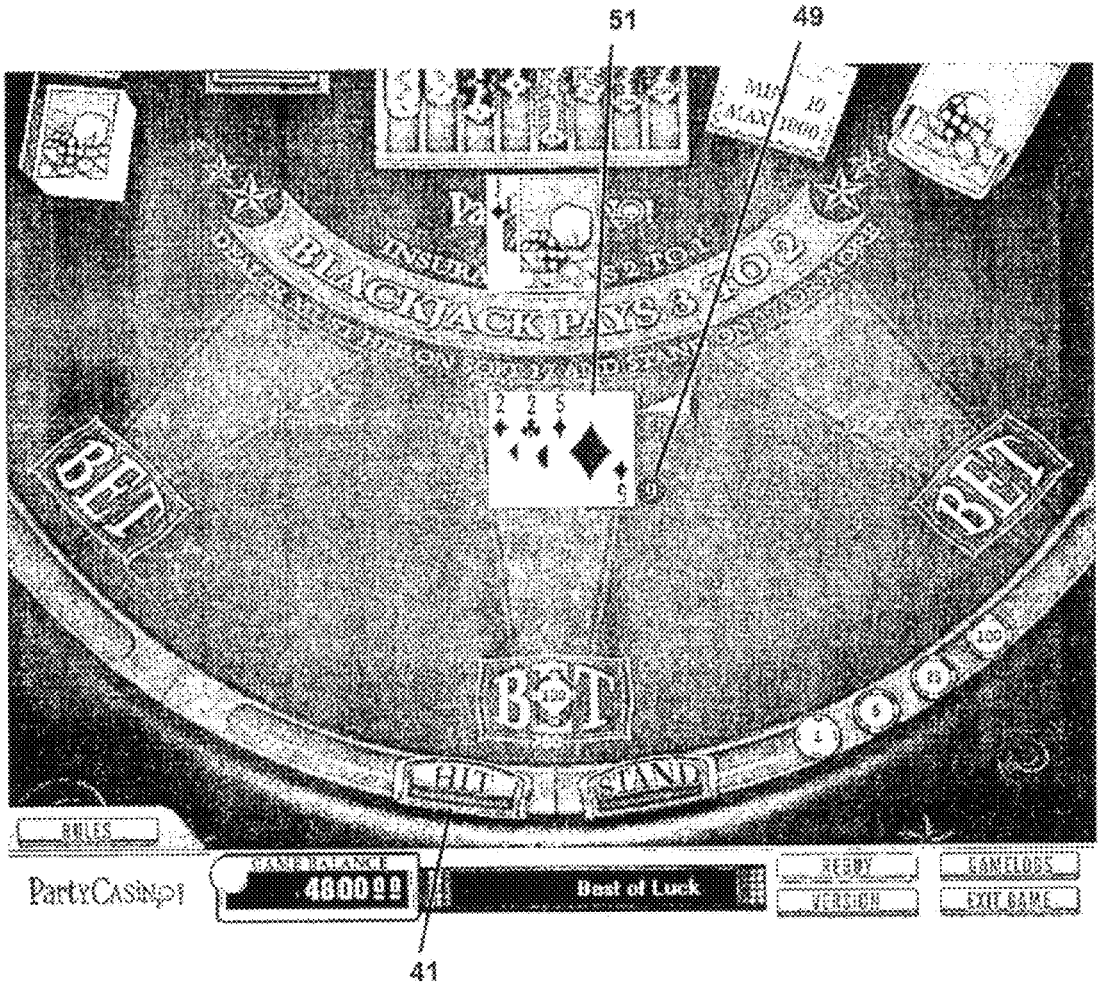
FIG. 5 is a screen shot showing a single-player blackjack table of a networked blackjack program, wherein a player has chosen to "Hit" and taken a supplementary card to his original two cards, as viewed by the player.

Referring to FIG. 5, a screen shot shows a single-player blackjack table of a networked blackjack program, wherein a player has chosen the hit option 41 and has taken a supplementary card 51; in this case the supplementary card is the five of diamonds. The player's point total 49 is now nine.

Figure 6:
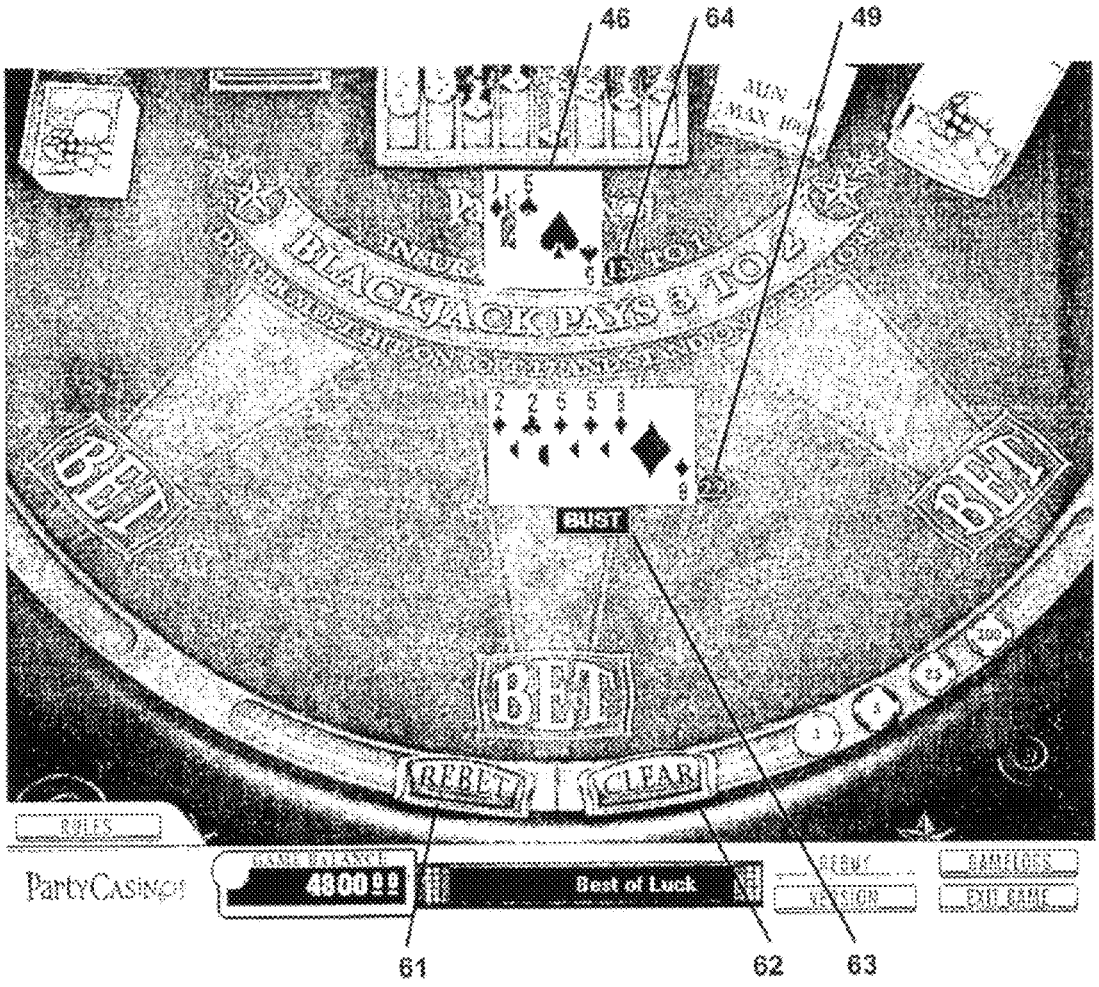
FIG. 6 is a screen shot showing a single-player blackjack table of a networked blackjack program, wherein a player has "busted" by accumulating a score greater than twenty-one, as viewed by the player.

Referring to FIG. 6, a screen shot shows a single-player blackjack table of a networked blackjack program, wherein a player has chosen to hit on three occasions, causing the player to take three supplementary cards. The player's point total 49, following the three supplementary cards, has reached twenty-two and the player has "busted." The outcome indicator 63 shows that the player has exceeded a point total 49 of twenty-one and has lost the hand. The dealer has turned over his face down card 46 to reveal a five of spades; thus the dealer's point total 64 is fifteen. The dealer wins this hand because the player has busted. Since the hand is over, the player now has a plurality of options for the next hand. The player may choose the rebet option 61 and place the same wager as was placed in the hand just completed. If the player decides he would like to change his bet, the player may choose the clear option 62 and place a different wager.

Figure 9:
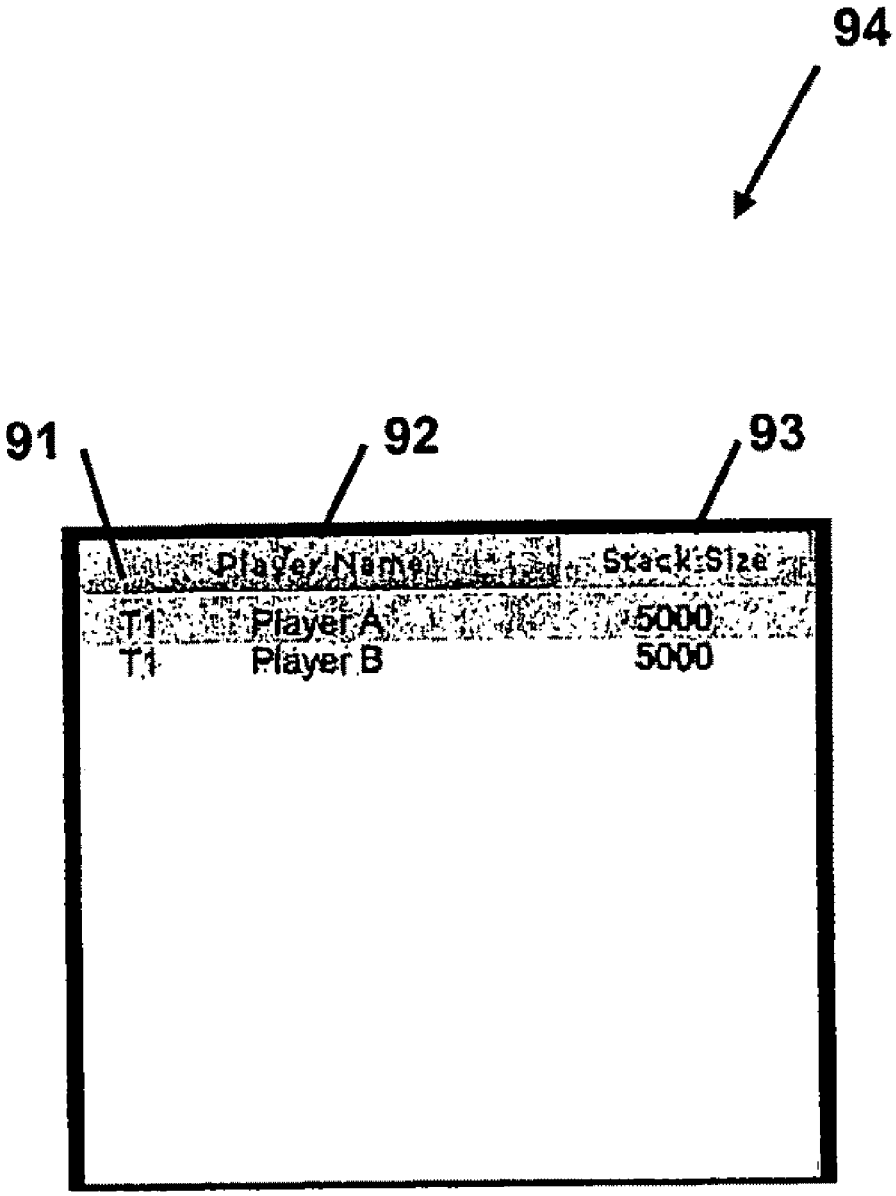
FIG. 9 is a leader board of a networked game tournament for a game such as blackjack, the tournament having two players, PlayerA and PlayerB.

In the preferred embodiment of the present invention, the tournament will start at a specified time. Each player will be required to play a specified number of hands to complete the tournament. A leader board 94, represented in FIG. 9, is available for display to each player and is updated as play progresses. The leader board 94 may include a players' ranks column 91, a players' names column 92, or a players' stack size or chip counts column 93. Other fields in the leader board 94 may also be present, as would be obvious to one having ordinary skill in the art. As shown in the embodiment in FIG. 9, the leader board 94 lists two players, Player A and Player B, who both have 5000 chips and are thus tied for first place. This tie is indicated by the players' ranks both being listed as "T1" (tied for $1^{st}$ place).

Figure 10A:
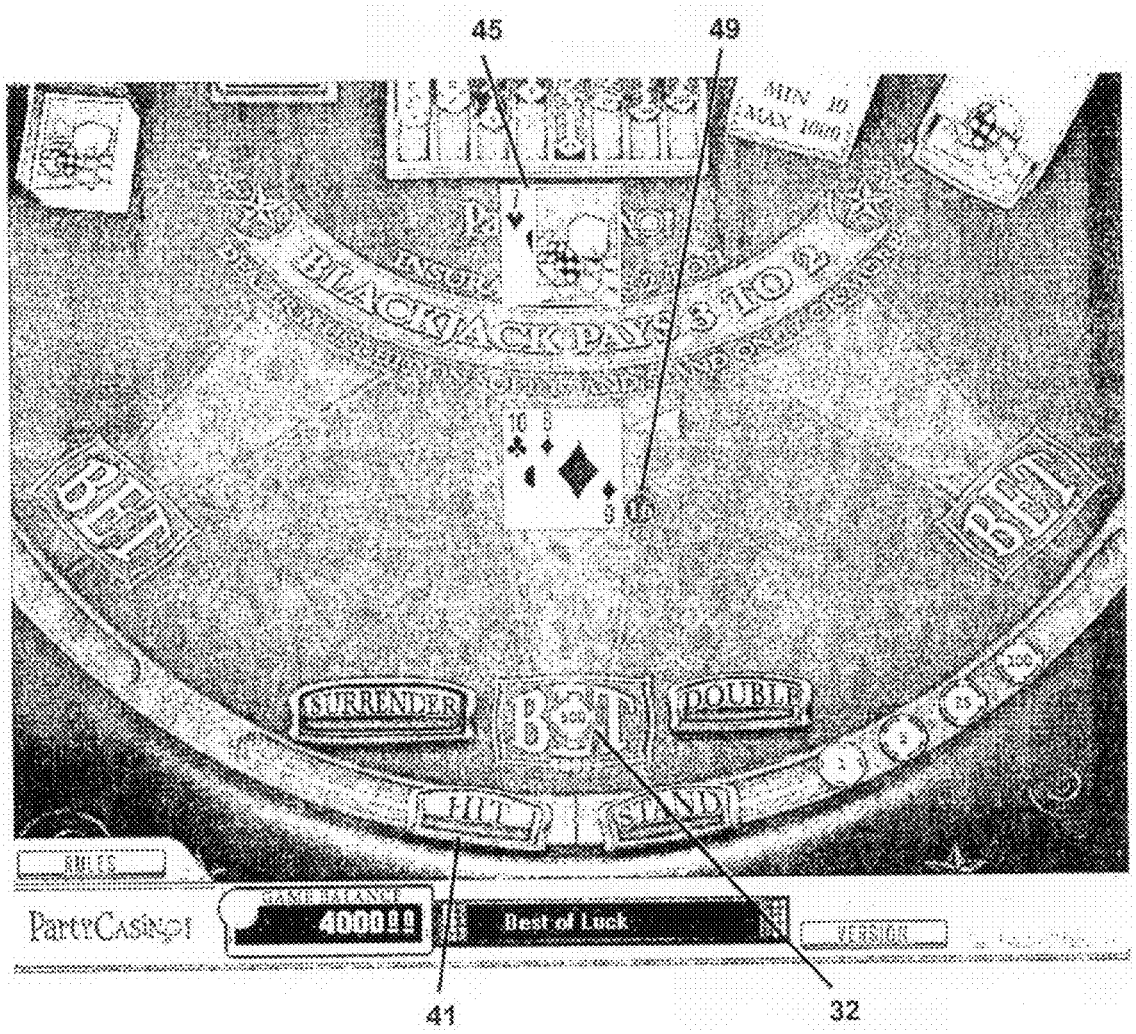
FIGS. 10*a*-10*c* are screen shots showing a single-player blackjack table of a networked blackjack program, wherein a player has chosen to "hit," then "stand," and eventually win the hand, as viewed by the player.
Figure 10B:
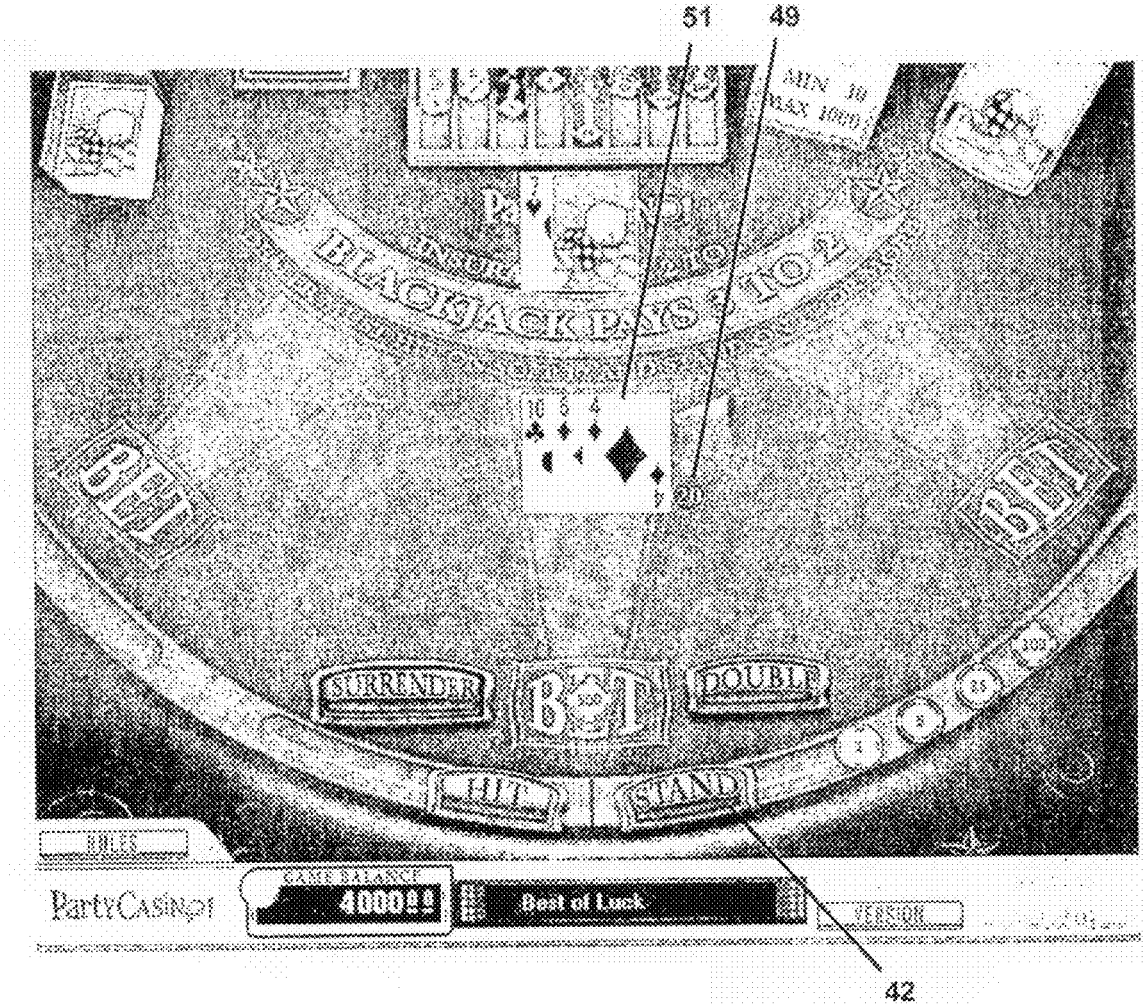
Figure 10C:
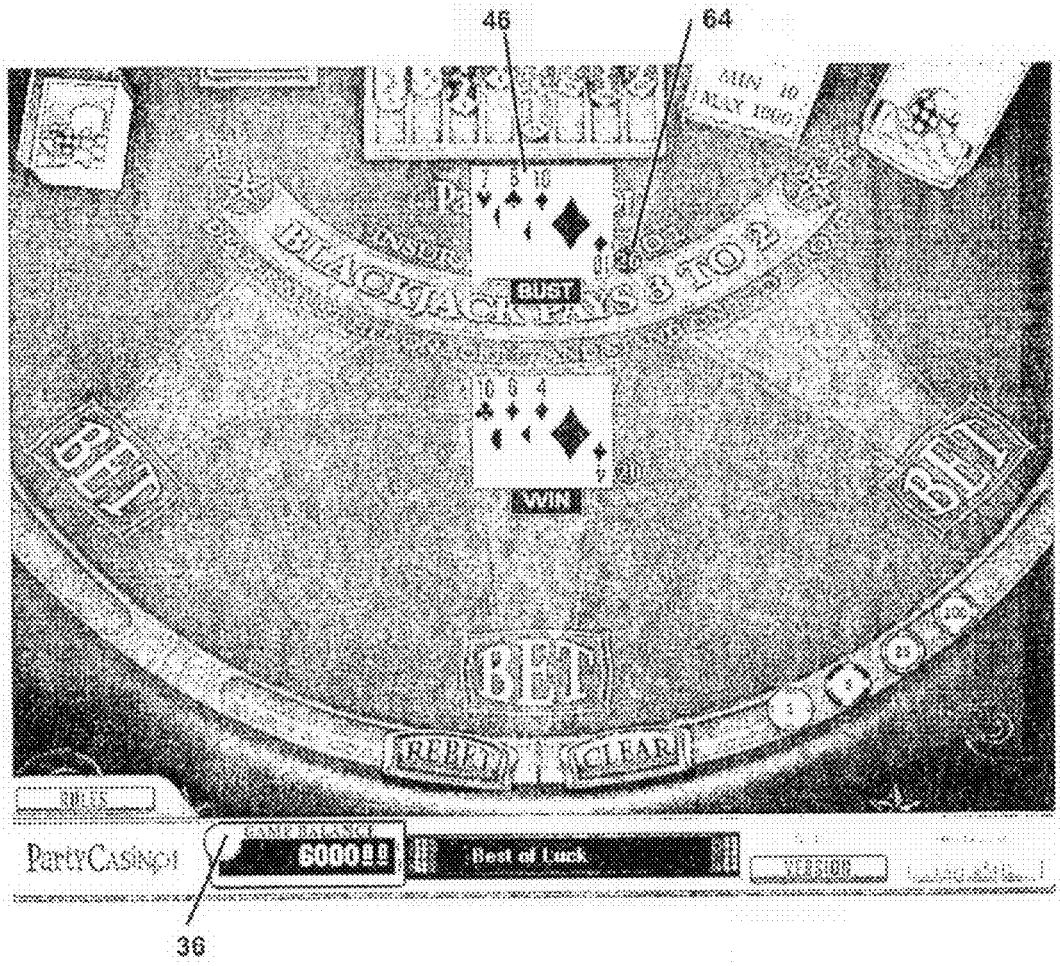
Figure 11A:
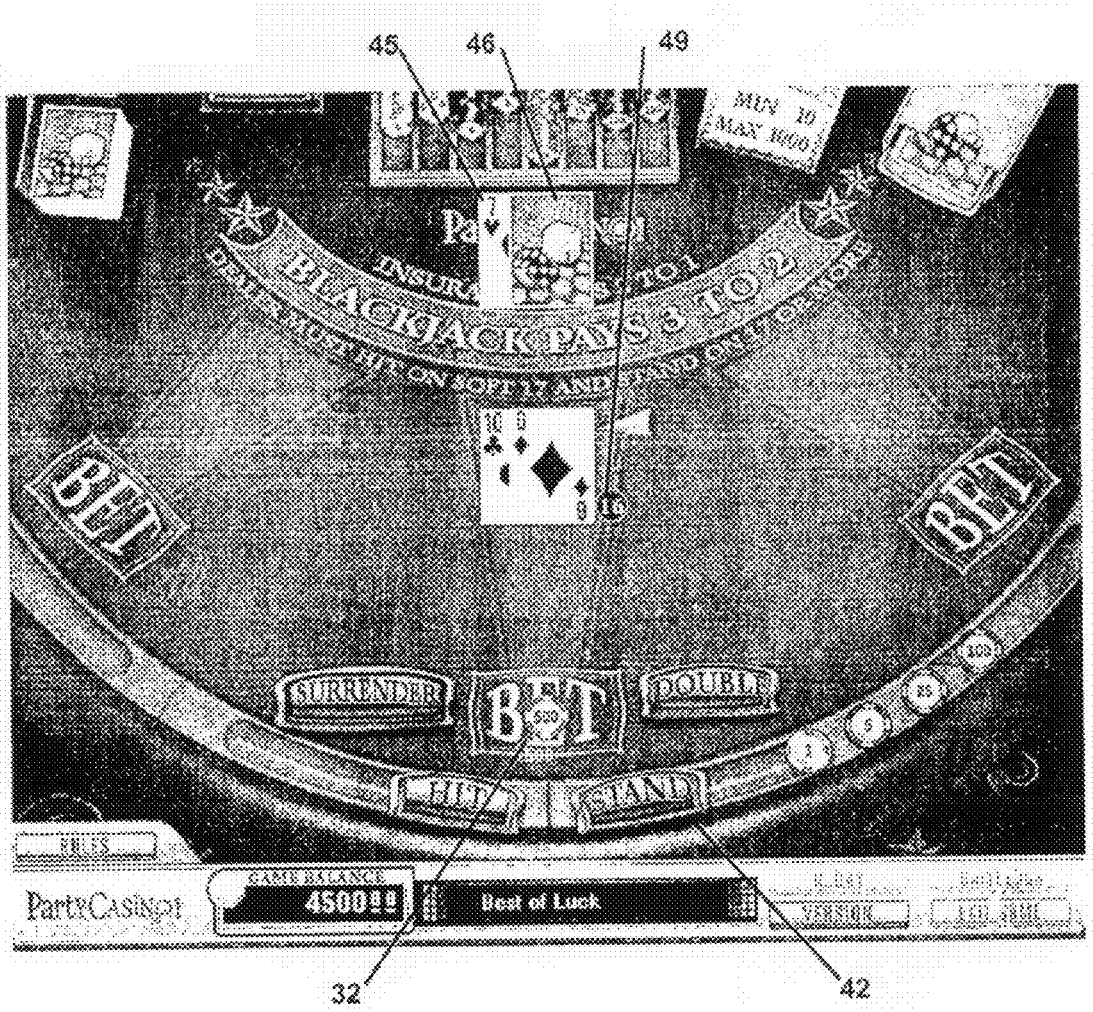
FIGS. 11*a*-11*b* are screen shots showing a single-player blackjack table of a networked blackjack program, wherein a player has chosen to "stand" and eventually loses the hand, as viewed by the player.
Figure 11B:
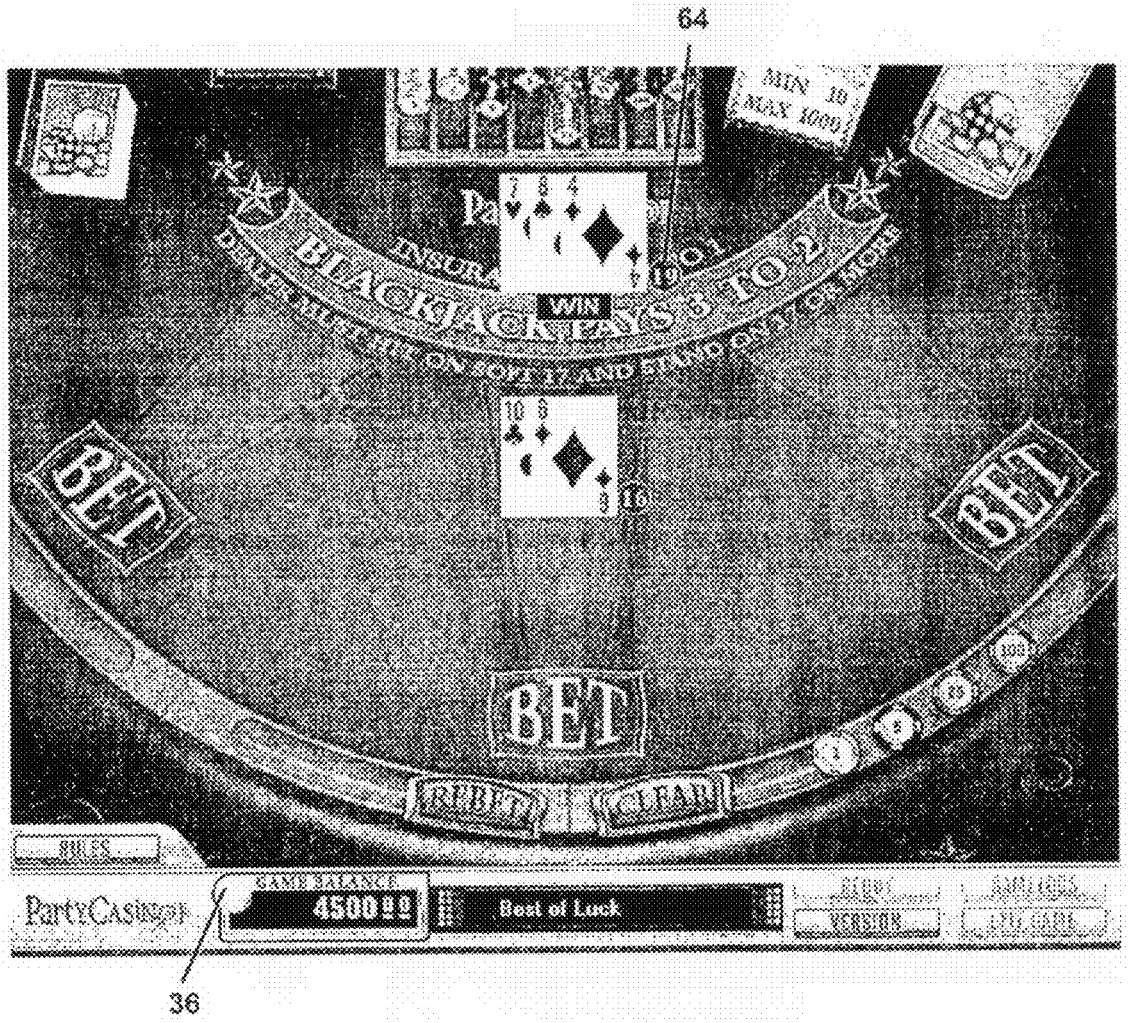

Each player in the tournament will be dealt the same hand as the other players. The dealer's cards in will also be identical on each table. For each hand, the system will then deal the same cards in the same order to each player and dealer; therefore, the only differentiator will be the betting strategy and playing style employed by each player. For example, assume there are only two players in a tournament, Player A and Player B. Player A's round is depicted in FIGS. 10*a*-10*c*. Player B's round is depicted in FIGS. 11*a*-11*b*. Both players begin the hand with 5,000 chips with a minimum and maximum table limit of 10 to 1,000. Referring to FIG. 10*a*, Player A places a bet 32 of 1,000 chips. Referring to FIG. 11*a*, Player B places a bet 32 of 500 chips. The initial cards are dealt, both being identical to each player. They are: players' hand 10 of clubs and 6 of diamonds. As seen in FIG. 10*a* and FIG. 11*a*, the dealer's face up card 45 is a seven of hearts.

Player A is the more aggressive player and takes a card by choosing the hit option 41, and the supplementary card 51 is the four of diamonds, as seen in FIGS. 10*a*-10*b*, giving Player A a point total 49 of twenty. Player A then chooses the stand option 42. The dealer's cards are revealed in FIG. 10*a*. The dealer turns over the face down card 46 and reveals the eight of spades. The dealer must hit because his point total 64 is only fifteen, and upon doing so the dealer gets the ten of diamonds. This causes the dealer's point total 64 to sum to 26, causing the dealer to bust. Player A wins this hand.

As seen in FIGS. 11*a*-11*b*, Player B decides to play cautiously and does not take a card and chooses the stand option 42 when his point total 49 is sixteen. The dealer then turns over his face down card 46 and reveals the eight of spades. The dealer must take another card, which ends up being the four of diamonds, making the dealer's point total 64 sum to nineteen.

Figure 12:
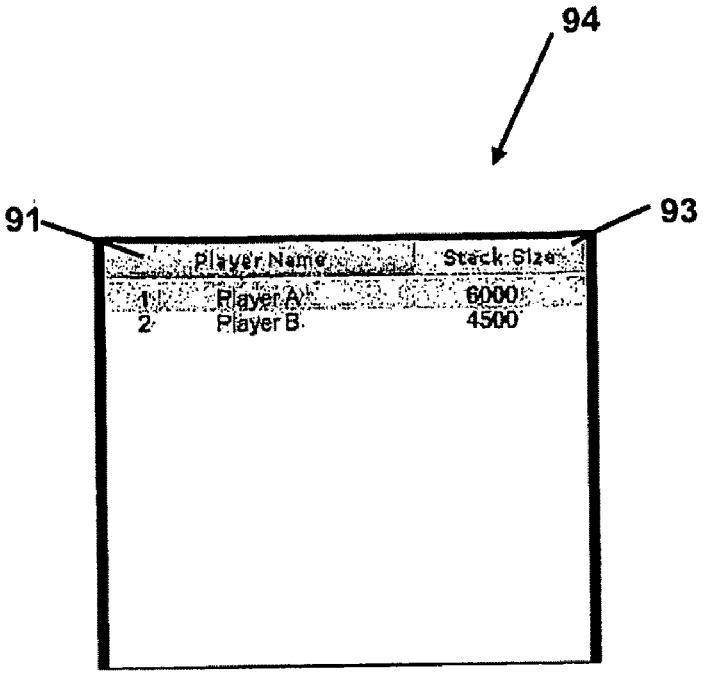
FIG. 12 is an updated leader board of a networked game tournament for a game such as blackjack, the tournament having two players, PlayerA and PlayerB.

As seen in FIG. 10*c* and FIG. 12, Player A wins 1,000 chips and his balance 36 is updated to show 6,000 chips. Player A now has chip count 93 of 6,000, as indicated in the leader board 94 of FIG. 12. As seen in FIG. 11*b* and FIG. 12, Player B loses 500 chips and his balance is updated to show 4,500 chips. Player B has a chip count 93 of 4,500, as indicated in the leader board 94 of FIG. 12. The leader board 94 has been updated and both players can determine what happened. The rank column 91 shows that Player A is in first place and Player B is in second place. Player A can see that player B lost 500 chips. Player A also knows that player B chose the stand option 42 on sixteen against a seven and therefore may be a cautious player. This may affect the strategy that Player A employs in the tournament. Player B can see that Player A won 1,000 chips. Player B can also see that Player A must have taken a card on sixteen against a seven and therefore may be an aggressive player. This may affect the strategy that Player B employs in the tournament.

Although this is a simple example this highlights how exciting the tournament could become with players attempting to devise effective strategies against different opponents. Each hand is synchronised to begin at the same time, therefore a player has a specified limited amount of time to make their decisions. The players will be able to see (or pop-up) a leader board which is updated after each hand to allow the players to see their positions within the tournament. At the end of the tournament the players are ranked according to their final chip counts, and prizes are distributed in accordance with the prize structure.

Figure 13:
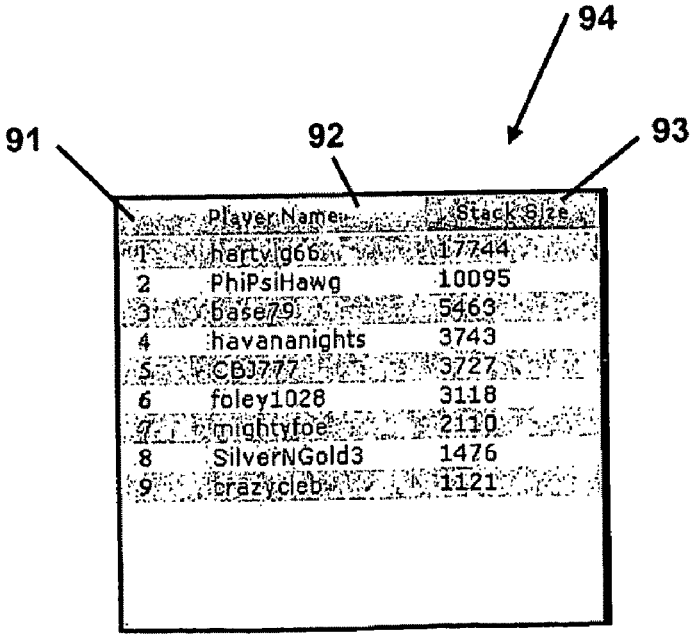
FIG. 13 is a leader board of a networked game tournament for a game such as blackjack, the tournament having nine players.

FIG. 13 shows a leader board 94 for an embodiment of the present invention wherein there are nine players in the tournament. The leader board 94 may include a players' ranks column 91, a players' names column 92, or a players' stack size or chip counts column 93. Other fields in the leader board 94 may also be present, as would be obvious to one having ordinary skill in the art.

If a player exhausts their chips before the end of the tournament they will post a score of zero on the leader board. If multiple players post a score of zero then the player who played the most number of hands will be higher than players who have played a lower number of hands. If both of these elements are the same they will be given equal rank. If in the final leader board positions two players have identical scores they will be given equal rank and the prizes (if applicable) will be split between the players. In another embodiment of the present invention, if multiple players post a score of zero to the leader board and these players have played the same number of hands, the a higher ranking will be given to a player who wagered more chips on his final hand. In this alternate embodiment, if multiple players post a score of zero and have played an equal number of hands, and further the players wagered the same amount on their respective last hands, then these players will be given equal rank.

The prize structure may be based on the following table determined on the number of entries. The house may deduct a specified portion of the entry fee (typically 10%) and the remaining funds split as determined below to the winning players.

Blackjack Tournament Prize Structure

| Place | # Of Entries - # Of Tables Paid | | | | | | | |
|---|---|---|---|---|---|---|---|---|
| Finished | 10-29 | 30-49 | 50-69 | 70-99 | 100-199 | 200-299 | 300-399 | 400-499 |
| 1st | 50.0% | 40.0% | 30.0% | 28.0% | 27.0% | 27.0% | 25.0% | 25.0% |
| 2nd | 30.0% | 25.0% | 20.0% | 17.0% | 15.7% | 15.5% | 15.0% | 15.0% |
| 3rd | 20.0% | 15.0% | 14.0% | 12.0% | 11.0% | 10.5% | 10.0% | 9.00% |
| 4th | | 11.0% | 10.0% | 10.0% | 9.00% | 8.00% | 7.00% | 7.00% |
| 5th | | 9.00% | 8.00% | 8.00% | 7.30% | 7.00% | 6.00% | 5.50% |
| 6th | | | 7.00% | 7.00% | 6.00% | 6.00% | 5.00% | 4.00% |
| 7th | | | 6.00% | 6.00% | 5.00% | 4.00% | 4.00% | 3.00% |
| 8th | | | 5.00% | 5.00% | 4.00% | 3.00% | 3.00% | 2.00% |
| 9th | | | | 4.00% | 3.00% | 2.00% | 2.00% | 1.50% |
| 10th | | | | 3.00% | 2.00% | 1.00% | 1.00% | 1.00% |
| 11th to 20th | | | | | 1.00% | 0.85% | 0.85% | 0.85% |
| 21st to 30th | | | | | | 0.75% | 0.70% | 0.70% |
| 31st to 40th | | | | | | | 0.65% | 0.60% |
| 41st to 50th | | | | | | | | 0.55% |

| Place | # Of Entries - # Of Tables Paid | | | | | | | | |
|---|---|---|---|---|---|---|---|---|---|
| Finished | 500-599 | 600-699 | 700-799 | 800-899 | 900-999 | 1000-1099 | 1100-1399 | 1400-1799 | 1800+ |
| 1st | 24.0% | 22.0% | 22.0% | 22.0% | 22.0% | 21.0% | 21.0% | 21.0% | 21.0% |
| 2nd | 15.0% | 15.0% | 13.0% | 12.5% | 12.0% | 11.8% | 11.7% | 10.7% | 10.6% |
| 3rd | 9.00% | 9.00% | 8.50% | 8.00% | 8.00% | 8.00% | 8.00% | 8.00% | 8.00% |
| 4th | 6.50% | 6.00% | 6.00% | 6.00% | 6.00% | 6.00% | 6.00% | 6.00% | 6.00% |
| 5th | 5.00% | 5.00% | 5.00% | 5.00% | 5.00% | 5.00% | 5.00% | 5.00% | 5.00% |
| 6th | 4.00% | 4.00% | 4.00% | 4.00% | 4.00% | 4.00% | 4.00% | 4.00% | 4.00% |
| 7th | 3.00% | 3.00% | 3.00% | 3.00% | 3.00% | 3.00% | 3.00% | 3.00% | 3.00% |
| 8th | 2.00% | 2.00% | 2.00% | 2.00% | 2.00% | 2.00% | 2.00% | 2.00% | 2.00% |
| 9th | 1.50% | 1.50% | 1.50% | 1.50% | 1.50% | 1.50% | 1.50% | 1.50% | 1.50% |
| 10th | 1.00% | 1.00% | 1.00% | 1.00% | 1.00% | 1.00% | 1.00% | 1.00% | 1.00% |
| 11th to 20th | 0.85% | 0.85% | 0.85% | 0.80% | 0.80% | 0.80% | 0.80% | 0.75% | 0.70% |
| 21st to 30th | 0.65% | 0.65% | 0.65% | 0.60% | 0.60% | 0.60% | 0.60% | 0.57% | 0.53% |
| 31st to 40th | 0.55% | 0.55% | 0.55% | 0.55% | 0.50% | 0.50% | 0.48% | 0.46% | 0.40% |
| 41st to 50th | 0.45% | 0.45% | 0.45% | 0.45% | 0.40% | 0.40% | 0.36% | 0.34% | 0.31% |
| 51st to 60th | 0.40% | 0.35% | 0.35% | 0.35% | 0.35% | 0.34% | 0.29% | 0.27% | 0.25% |
| 61st to 70th | | 0.30% | 0.30% | 0.30% | 0.30% | 0.28% | 0.23% | 0.21% | 0.19% |
| 71st to 80th | | | 0.25% | 0.25% | 0.25% | 0.23% | 0.18% | 0.18% | 0.17% |
| 81st to 90th | | | | 0.20% | 0.20% | 0.18% | 0.16% | 0.15% | 0.14% |
| 91st to 100th | | | | | 0.15% | 0.14% | 0.14% | 0.13% | 0.12% |
| 101st to 120th | | | | | | 0.10% | 0.12% | 0.11% | 0.10% |
| 121st to 140th | | | | | | | 0.10% | 0.09% | 0.09% |
| 141st to 180th | | | | | | | | 0.08% | 0.08% |
| 81st to 220th | | | | | | | | | 0.07% |

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A system for conducting a blackjack tournament, comprising:

a plurality of game tables for seating a plurality of players with the same predetermined starting amount of funds to wager;

the system configured to deal to each player from his or her own at least one deck of playing cards arranged in the same predetermined order as an at least one deck used for each other player;

the system additionally comprising a dealer that is configured, if the dealer requires one or more additional cards when playing against a first player, to receive cards from the first player's deck after the first player has been dealt a last card for the hand; and the system further comprising a dealer that is configured, if the dealer requires one or more additional cards when playing against a second player, to receive cards from the second player's deck after the second player has been dealt a last card for the hand;

wherein said tournament is in an electronic format; and wherein said tables are virtual tables and said cards are virtual cards.

2. The system of claim 1, wherein, said funds are virtual funds.

3. The system of claim 1, wherein said tournament is on a network.

4. The system of claim 1, including a prize structure based at least in part on the number of players.

5. The system of claim 1, wherein a prize structure is determined by a chart, based at least in part on the number of players.

6. The system of claim 1, wherein wagering minimum and maximum bets are specified.

7. The system of claim 1, wherein the system is configured to require each player to play a specified number of hands in order to complete the tournament.

8. The system of claim 1, including a leader board available to be viewed by each player.

9. The system of claim 1, wherein the system is configured to deal the same initial hand in each new hand to each player, from at least one deck of playing cards arranged in the same predetermined order as the at least one deck used for each other player, the system further configured to use a new at least one deck for each new hand.

10. The system of claim 1, wherein the system is configured to synchronize each hand to begin at the same time and to provide each player with a predetermined amount of time to make decisions.

11. The system of claim 1, further a leader board that is configured to be updated after each hand.

12. The system of claim 1, wherein the system is configured to rank each player at the end of the tournament according to their final chip count, and further is configured to distribute prizes in accordance to the prize structure.

13. The system of claim 12, wherein the system is configured to post a score of zero on the leader board for a player who exhausts their chips before the end of the tournament.

14. The system of claim 12, wherein the system is configured, if multiple players post a score of zero, to rank the player who played the greatest number of hands higher than players who have played a lesser number of hands.

15. The system of claim 12, wherein the system is configured to give equal rank to players who post a score of zero and play the same number of hands.

16. The system of claim 12, wherein the system is configured to give a higher ranking to a player who wagers more chips on his final hand if the player is one of multiple players who post a score of zero and play the same number of hands.

17. The system of claim 12, wherein the system is configured to give multiple players equal rank if those multiple players post a score of zero and play the same number of hands, and further if the players wager the same amount on their respective last hands.

18. The system of claim 1, wherein the system is configured to give equal rank to multiple players and to split prizes between players of equal rank if multiple players have identical scores in a final leader board.

19. A method for conducting a blackjack tournament among a plurality of players, comprising:

dealing cards to a first player using a computer from at least one deck of playing cards;

dealing cards to a second player using a computer from a second at least one deck of playing cards;

wherein cards in the at least one deck are arranged in the same order as cards in the second at least one deck;

wherein the first player plays against a dealer and, if the dealer requires one or more additional cards, dealing cards to the dealer from the first deck after the first player has been dealt a last card for the hand; and wherein the second player plays against a dealer and, if the dealer requires one or more additional cards, dealing cards to the dealer from the second deck after the second player has been dealt a last card for the hand.

20. A method according to claim 19, wherein said dealing steps comprise displaying virtual cards on one or more displays of said computers.

21. A method for conducting a blackjack tournament among a plurality of players on one or more computers, comprising:

displaying cards to a first player on a computer from at least one deck of playing cards;

displaying cards to a second player on a computer from a second at least one deck of playing cards;

wherein cards in the at least one deck are arranged in the same order as cards in the second at least one deck; and wherein cards dealt to the second player are unaffected by cards dealt to the first player;

wherein, if a dealer requires one or more additional cards when playing against the second player, the method further comprises displaying cards from the second at least one deck for the dealer after the second player has been dealt a last card for the hand.

22. A method according to claim 21, wherein the first player plays against a first dealer and the second player plays against a second dealer;

wherein the first dealer receives cards from the first deck and the second dealer receives cards from the second deck; and wherein the first dealer and the second dealer are dealt at least the same first card.

* * * * *